United States Patent [19]

Kanto et al.

[11] Patent Number: 4,708,680

[45] **Date of Patent: * Nov. 24, 1987**

[54] COLOR PICTURE TUBE AND METHOD FOR MANUFACTURING THE SAME

[75] Inventors: Masaharu Kanto; Eiichi Akiyoshi, both of Hyogo; Yasuhisa Ōhtake, Fukaya, all of Japan

[73] Assignee: Tokyo Shibaura Denki Kabushiki Kaisha, Kawasaki, Japan

[ * ] Notice: The portion of the term of this patent subsequent to Aug. 20, 2002 has been disclaimed.

[21] Appl. No.: 818,269

[22] Filed: Jan. 13, 1986

Related U.S. Application Data

[62] Division of Ser. No. 519,246, Aug. 1, 1983, abandoned.

[30] Foreign Application Priority Data

Aug. 5, 1982 [JP] Japan ..... 57-135720
Aug. 5, 1982 [JP] Japan ..... 57-135721
Aug. 5, 1982 [JP] Japan ..... 57-135722

[51] Int. Cl.[4] ..... H01J 9/00

[52] U.S. Cl. ..... 445/47; 148/12.1; 148/134

[58] Field of Search ..... 148/12.1, 134; 445/47

[56] References Cited

U.S. PATENT DOCUMENTS 3,642,595 2/1972 Saul ..... 148/134
3,909,311 9/1975 Yamada et al. ..... 148/12.1
4,210,843 7/1980 Avadani ..... 148/12.1
4,271,571 6/1981 Tsuda et al. ..... 445/47
4,306,172 12/1981 Matsukura et al. ..... 445/47 X
4,536,226 8/1985 Ohtake et al. ..... 148/12.1

FOREIGN PATENT DOCUMENTS 2350366 4/1975 Fed. Rep. of Germany .
2231101 12/1974 France .
2240520 3/1975 France .
58977 5/1975 Japan .
20321 2/1977 Japan ..... 148/12.1
2060696 5/1981 United Kingdom .

*Primary Examiner*—Kenneth J. Ramsey
*Attorney, Agent, or Firm*—Cushman, Darby & Cushman

[57] ABSTRACT

A color picture tube comprises a shadow mask which is formed to, oppose at a small gap therefrom, a phosphor screen formed on the inner surface of a panel. The shadow mask comprises a sheet of a nickel-containing iron alloy which contains 0.1% by weight or less of manganese and having an austenite grain number of 7 or less both within and at surfaces of the sheet, the austenite grain number being defined by JIS G 0551 of the Japanese Industrial Standards. The iron alloy sheet is annealed in a vacuum of $10^{-1}$ Torr or less at a temperature of 1,000° C. or higher prior to formation into the shadow mask.

3 Claims, 18 Drawing Figures

FIG. 6(a)
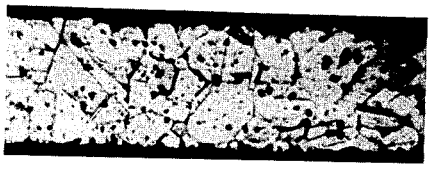
FIG. 6(b)
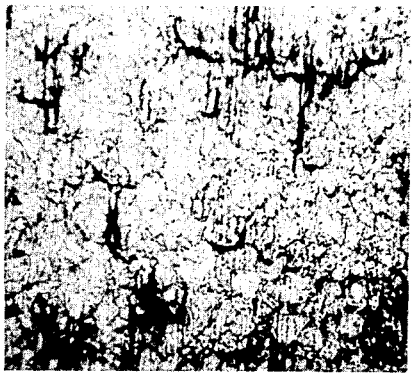
FIG. 7(a)
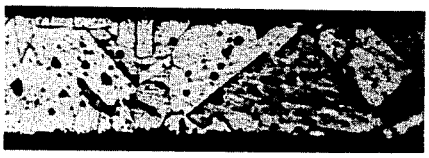
FIG. 7(b)
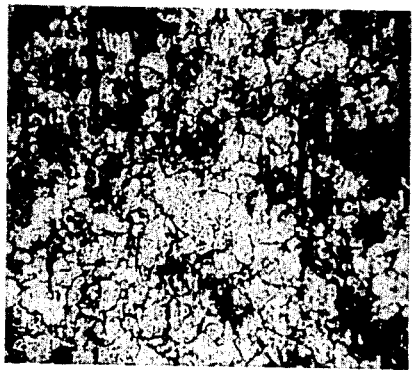
FIG. 8(a)
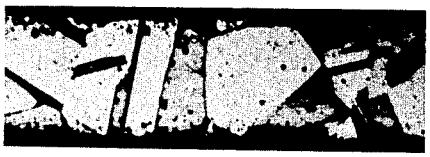
FIG. 8(b)
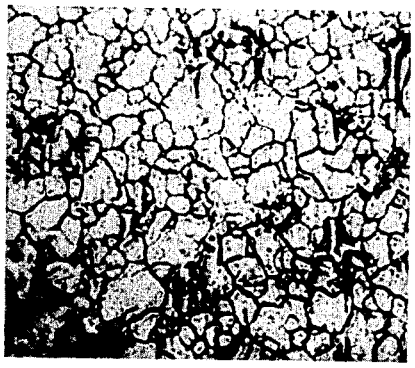
FIG. 9

COLOR PICTURE TUBE AND METHOD FOR MANUFACTURING THE SAME

This is a division of application Ser. No. 519,246, filed Aug. 1, 1983, and now abandoned.

BACKGROUND OF THE INVENTION

The present invention relates to a color picture tube and, more particularly, to a shadow mask thereof and to a method for manufacturing the same.

In a conventional color picture tube as shown in FIG. 1, three electron beams 1 to 3 from electron guns (not shown) are correctly radiated onto red, green and blue phosphors 7 to 9 coated on the inner surface of a panel 6 through apertures 5 regularly formed in a shadow mask 4. The phosphors 7 to 9 then emit red, green and blue light to form a color image.

A shadow mask in a color picture tube of this type must satisfy certain specific requirements. That is, small apertures must be correctly formed in a regular pattern. The shadow mask must be curved in a predetermined radius of curvature. The distance (to be referred to as the g value hereinafter) between the shadow mask and the inner surface of the panel must be maintained at a predetermined value.

When the color picture tube is operated, the electron beams which pass through the apertures formed in the shadow mask comprise $\frac{1}{3}$ or less of the electron beams originally emitted by the electron guns. The remaining electron beams bombard against the shadow mask which is, in some cases, thereby heated to a temperature of up to 80° C. As a result, the shadow mask thermally expands to have a g value different from the predetermined g value, thus causing the dome phenomenon. When the dome phenomenon occurs, the color purity of the color picture tube is degraded. The material which is conventionally used for a shadow mask and which contains pure iron as a major component, such as Al-killed decarbonized steel, has a coefficient of thermal expansion of about $12\times10^{-6}$/deg. at 0° to 100° C. This material is thus easily vulnerable to the dome phenomenon.

In view of this problem, Japanese Patent Publication No. 42-25446, Japanese Patent Disclosure No. 50-58977 and Japanese Patent Disclosure No. 50-68650 propose the use of a material which has a small coefficient of thermal expansion, such as an iron-nickel alloy, as the material of a shadow mask. However, this proposal has not yet led to a practical use of such a material in a shadow mask. One of the reasons which prevents the use of such a material is the difficulty in working a metal sheet consisting of an iron-nickel alloy. In order that the g value fall within a predetermined allowable range, the curved surface of the shadow mask must be controlled with high precision. The allowable error in a radius of curvature R of 1,000 mm is as small as ±5 mm.

An iron-nickel type alloy has an extremely high modulus of elasticity and a high tensile strength after annealing as compared to conventional alloys containing iron as a major component. Accordingly, the iron-nickel type alloy has an inferior curved surface formability by pressing or the like. For example, when a local collapse is formed upon curving an iron-nickel sheet of 0.2 mm thickness to the radius of curvature R as shown in FIG. 2, the degradation in the color purity of the color picture tube is considered negligible if the collapsing quantity d remains 20 μm or less. FIG. 3 shows the collapsing quantity d vs yield point strength characteristics of the material of a 14" type shadow mask. It is seen from the graph shown in FIG. 3, that the yield point strength must be suppressed to 20 kg/mm$^2$ or less in order to maintain the collapsing quantity d at 20 μm or less. However, a shadow mask consisting of an iron-nickel type alloy has a yield point strength (curve b) as shown in FIG. 4, which is significantly higher than that (curve a) of a shadow mask consisting of a conventional Al-killed decarbonized steel in the case where both are annealed in hydrogen in an annealing furnace generally used for the conventional Al-killed decarbonized steel. Even if a shadow mask consisting of an iron-nickel type alloy is annealed at a high temperature of 900° C., the yield point strength is only lowered to 29 to 30 kg/mm$^2$. Referring to FIG. 3, since no clear boundary was obtained for the yield point strength of the iron-nickel type alloy, a tensile strength after 0.2% elongation is plotted instead. Since a shadow mask consisting of an iron-nickel type alloy has a small coefficient of thermal expansion, degradation in color purity due to a high coefficient of thermal expansion is substantially eliminated. However, degradation in color purity due to deformation and a large collapsing quantity upon curved surface formation still remains.

SUMMARY OF THE INVENTION

It is an object of the present invention to provide a color picture tube having a shadow mask which has a small coefficient of thermal expansion and good curved surface formability, and wherein degradation in color purity due to deformation is eliminated.

According to an aspect of the present invention, there is provided a color picture tube comprising a shadow mask which is formed to oppose, at a small gap therefrom, a phosphor screen formed on an inner surface of a panel, wherein the shadow mask comprises a sheet of a nickel-containing iron alloy, the iron alloy containing 0.1% by weight or less of manganese and having an austenite grain number of 7 or less both within and at surfaces of the sheet, the austenite grain number being defined by JIS G 0551 of the Japanese Industrial Standards.

According to another aspect of the present invention, there is also provided a method for manufacturing a color picture tube, comprising the steps of forming a number of apertures in a sheet consisting of a nickel-containing iron alloy; annealing the sheet in a vacuum of $10^{-1}$ Torr or less at a temperature of 1,000° C. or higher, so as to reduce a manganese content of said iron alloy to 0.1% by weight or less, and to render an austenite grain number both within and at surfaces of the sheet to be 7 or less, the austenite grain number being defined by JIS G 0551 of the Japanese Industrial Standards; forming the annealed sheet to form a shadow mask; and opposing the shadow mask at a small gap therefrom against a phosphor screen formed on an inner surface of a panel.

In this specification, the austenite grain number defined by JIS G 0551 means a grain number representing the size of the austenite crystal grains which is determined by a solid solubilization temperature and a time for maintaining such a solubilization temperature when a steel is heated to a temperature higher than the transformation point or to a temperature of heat treatment for solid solubilization for the purpose of annealing, normalizing and the like. Grain number (N) and the number (n) of crystal grains per unit sectional area of $mm^2$ hold the following relation:

$$n=2^{N+3}$$

Accordihgly, when N is 7, n is 1024. When N is 1, n is 16. Thus, the grain size increases proportionally to a decrease in the grain number (N).

BRIEF DESCRIPTION OF THE DRAWINGS

FIGS. 6(*a*) to 8(*a*) and 6(*b*) to 8(*b*) are photomicrographs of sections and surfaces, respectively, of a crystal structure of a shadow mask sheet prepared by a conventional method, the magnification in FIGS. 6(*a*) to 8(*a*) being 200 times and that in FIGS. 6(*b*) to 8(*b*) being 240 times;

DETAILED DESCRIPTION OF THE PREFERRED EMBODIMENTS

Figure 1:
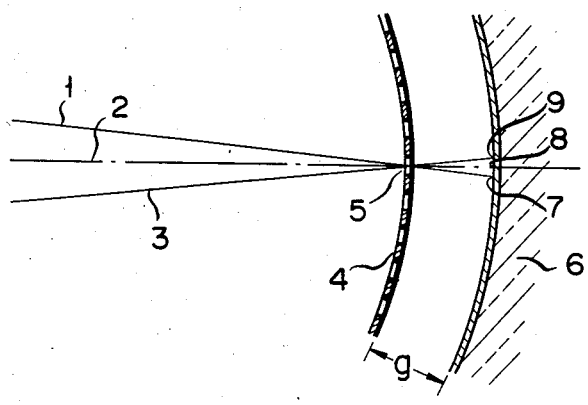
FIG. 1 is a representation for explaining the mode of operation of a color picture tube.
Figure 2:
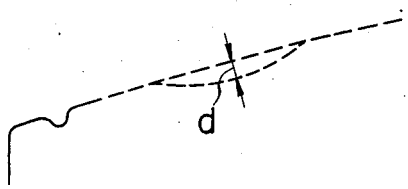
FIG. 2 is a schematic representation of the main part of a shadow mask for explaining deformation therein.
Figure 3:
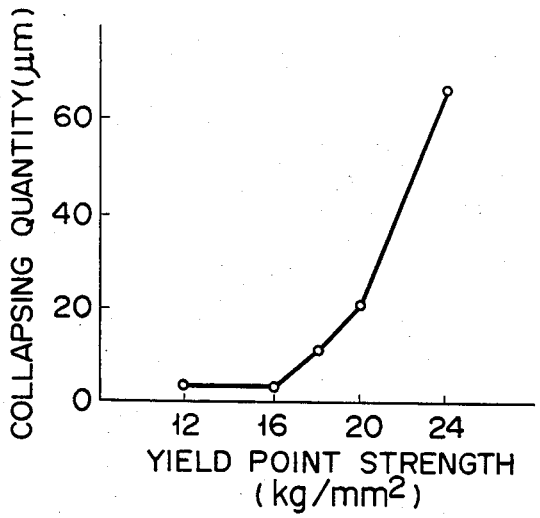
FIG. 3 is a graph showing the collapsing quantity as a function of the yield point strength of a shadow mask sheet.
Figure 4:
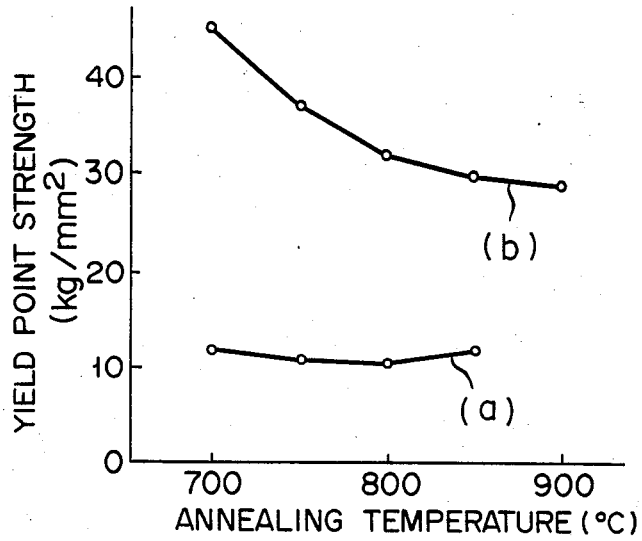
FIGS. 4 and 5 are graphs showing the yield point strength as a function of the annealing temperature of a shadow mask sheet.

The present invention will now be described with reference to an Example wherein an Invar alloy, which contains as a major component an iron-nickel type alloy, is used as a material for a shadow mask. Since the structure of a color picture tube of the present invention is basically the same as that shown in FIG. 1, a detailed description thereof will be omitted.

Table 1 below shows the composition (% by weight; before annealing) of an Invar alloy used in the Example of the present invention and a conventional Al-killed decarbonized steel.

TABLE 1

| | Composition (wt %) of Shadow Mask Material | | | | | | | |
|---|---|---|---|---|---|---|---|---|
| | Composition | | | | | | | |
| Type | C | Mn | Si | P | S | Al | Ni (+Co) | Fe |
| Invar alloy | 0.009 | 0.47 | 0.13 | 0.005 | 0.002 | — | 36.5 | Balance |
| Al-killed decarbonized steel | 0.002 | 0.30 | <0.01 | 0.016 | 0.009 | 0.052 | — | Balance |

Figure 5:
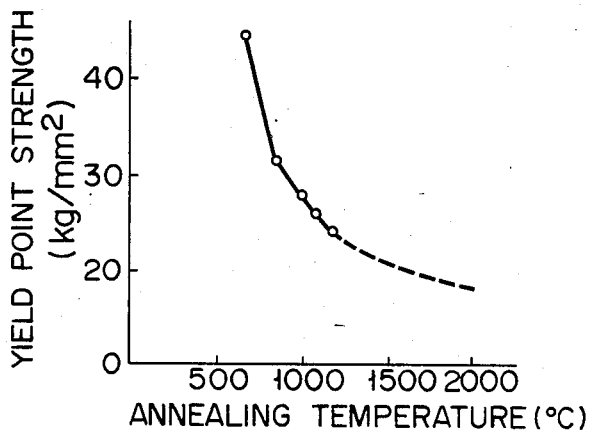

FIG. 5 shows the yield point strength as a function of the annealing temperature when a shadow mask sheet consisting of 36Ni Invar alloy having the composition as shown in Table 1 above was heated in a conventional annealing step in a hydrogen atmosphere in an annealing furnace. As may be seen from FIG. 5, even if the sheet is annealed at a temperature as high as 1,200° C., the yield point strength is only reduced to 24 $kg/mm^2$. Accordingly, in order to suppress the yield point strength to 20 $kg/mm^2$ or less which is satisfactory for curved surface formation, extrapolation of the results shown in the graph shown in FIG. 5 reveals that the annealing temperature must fall within the range of 1,500° to 1,700° C. However, since the Invar alloy has a melting point of 1,440° to 1,455° C., simple heating to a temperature within the above-mentioned range cannot be performed.

FIGS. 6 to 8 are photomicrographs showing the crystal structure of sample sheets made of an Invar alloy when the annealing was effected in a hydrogen atmosphere 1,000° C., 1,100° C. and 1,200° C., respectively, for 10 minutes. The thickness of each sheet was 0.2 mm.

FIGS. 6(*a*) to 8(*a*) show sections and FIGS. 6(*b*) to 8(*b*) show surfaces of the sheets. As may be seen from the photographs in FIGS. 6 to 8, the grain size increases with an increase in the annealing temperature. The crystal grains within the sheet had a grain number of 7 as defined by JIS G 0551 when the annealing temperature was 1,000° C., and a grain number of 7 or less when the annealing temperature was 1,100° C. and 1,200° C., respectively. Thus, the grain size within the sheet is seen to increase. However, the grains at the surface of the sheet hardly grow at all and had a grain number of 8 or more even when the annealing temperature was 1,200° C.

The retarded growth of the crystal grains at the surface is associated with the yield point strength. The difference between the growth of crystal grains within and at the surfaces of the sheet is considered to be attributable to slight segregation of impurities in the direction of thickness of the sheet, particularly at the grain boundaries in the vicinity of the surface of the sheet.

Figure 9A:
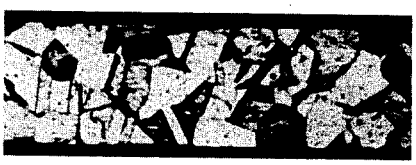
FIGS. 9(*a*) to 11(*a*) and 9(*b*) to 11(*b*) are photomicrographs of sections and surfaces, respectively, of a crystal structure of a shadow mask sheet prepared by a method used in the Example of the present invention, the magnification in FIGS. 9(*a*) to 11(*a*) being 200 times and that in FIGS. 9(*b*) to 11(*b*) being 240 times.
Figure 9B:
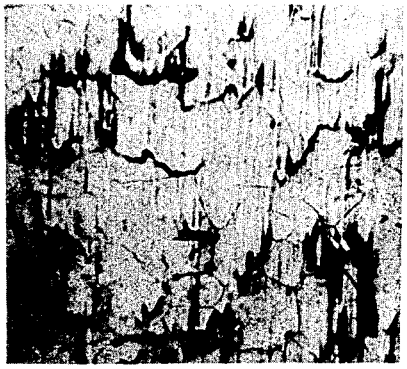
Figure 10A:
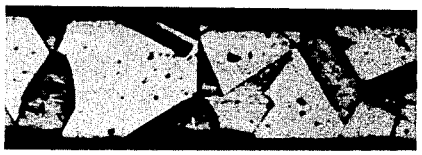
Figure 10B:
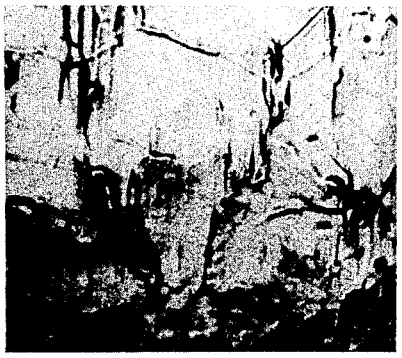
Figure 11A:
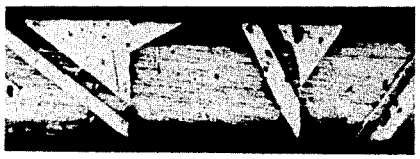
Figure 11B:
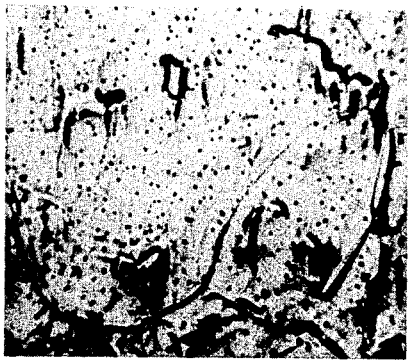

In the following Example, the sheet was annealed in a vacuum. FIGS. 9 to 11 show photomicrographs showing the crystal structure of sample sheets made of an Invar alloy when the sheets were annealed in a vacuum of $10^{-3}$ Torr at 1,000° C., 1,100° C. and 1,200° C., respectively, for 10 minutes. The thickness of each sheet was 0.2 mm. FIGS. 9(*a*) to 11(*a*) show sections while FIGS. 9(*b*) to 11(*b*) show surfaces of the sheets. As may be seen from FIGS. 9 to 11, according to this annealing method, crystal grains grow well both within and at the surfaces of the sheets. When the sheet was annealed at a temperature of 1,000° C., the crystal grains at the surface of the sheet had a grain number of 7 or less, which was the same as that of the grains within the sheet. The annealing temperature of about 1,200° C. is practical, which results in a grain number of about 3.

Figure 12:
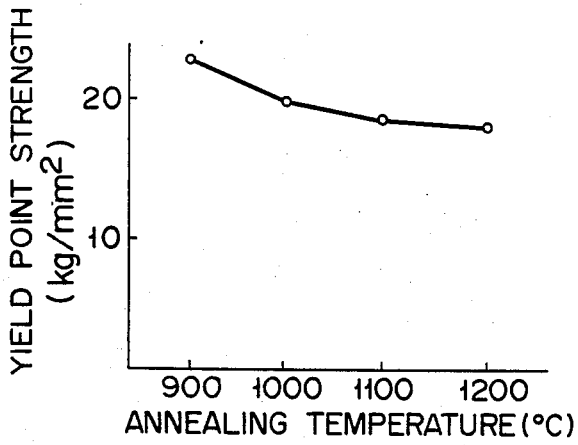
FIG. 12 is a graph showing the yield point strength as a function of the annealing temperature of the shadow mask sheet prepared in the Example of the present invention.

FIG. 12 shows the yield point strength as a function of the annealing temperature used during annealing under vacuum conditions as defined above of an Invar alloy sheet for a shadow mask. A yield point strength of 20 $kg/mm^2$, which is practically satisfactory for curved surface formation, may be obtained by annealing at a temperature higher than 1,000° C.

Table 2 below shows the results of an analysis of impurities in a surface layer (layer having a thickness of 1/20 mm or less) which are considered to prevent satisfactory growth of the crystal grains at the surface of the sheet.

TABLE 2

| Annealing in vacuum | Composition (wt %) Before and After Annealing | | | | | | |
|---|---|---|---|---|---|---|---|
| | C | Mn | Si | P | S | Ni (+Co) | Fe |
| Before annealing | 0.009 | 0.47 | 0.13 | 0.005 | 0.002 | 36.5 | Balance |
| After annealing | 0.007 | 0.052 | 0.12 | <0.001 | <0.001 | 36.3 | Balance |

As may be seen from Table 2 above, impurities other than iron and nickel in the sheet are mostly decreased after annealing in a vacuum. In particular, manganese (Mn) is reduced to about 1/10 its original amount, and phosphorus (P) and sulfur (S) are reduced to undetectable levels. Manganese is included in the sheet in order to allow a sheet for a shadow mask to be rolled to a predetermined thickness of 0.1 to 0.3 mm. The sheet generally contains 0.3 to 0.5% by weight of manganese.

When the amount of manganese is less than the lower limit given above, the rolling property of the sheet is degraded and cracking tends to occur. However, after rolling, manganese is not required. In particular, in the case of an iron-nickel type alloy, the presence of manganese impairs the curved surface formability. The rolling property of the sheet is considered to be improved by the addition of manganese for the following reasons. When a sheet for a shadow mask containing impurities such as manganese is annealed in a vacuum, manganese, phosphorus, sulfur and so on which have high vapor pressures are vaporized through grain boundaries to facilitate growth of crystal grains. In addition to this, oxides and the like of the impurities which tend to be formed during annealing in an atmosphere are hardly formed in the surface layer of the sheet. Thus, crystal grains grow at the same rate both within and in the vicinities of the surfaces of the sheet.

When a sheet for a shadow mask consisting of an Invar alloy, which was obtained by annealing in a vacuum and had a yield point strength of 20 kg/mm$^2$ or less, was formed into a predetermined shape, there occurred no problem in curved surface formability. When the amount of manganese in the sheet after annealing in the vacuum exceeded 0.1% by weight, the curved surface formability of the sheet was confirmed to be impaired. A color picture tube having a shadow mask prepared in this manner has a coefficient of thermal expansion which is as small as $1\times10^{-6}$/deg. to $2\times10^{-6}$/deg. at temperatures within the range of 0° to 100° C. Accordingly, such a color picture tube will not suffer from the problem of degradation in color purity due to thermal expansion of the shadow mask and due to mechanical deformation of the shadow mask. In general, Mn, Cr, Cu, C and the like increase the coefficient of thermal expansion of Invar alloy. Accordingly, the reduction due to annealing in the amount of Mn is also preferable in this context.

The above Example is described with reference to a case wherein the sheet for a shadow mask is annealed in a vacuum of $10^{-3}$ Torr. However, it was confirmed that a similar effect may be obtained if the vacuum pressure remains at $10^{-1}$ Torr or less. The residual gas in the atmosphere at this vacuum pressure may be an oxidizing gas, a reducing gas, or an inert gas. If the pressure is increased above this critical value, evaporation of the impurities is prevented, and a good effect is not obtained. The material of the sheet for a shadow mask according to the present invention is not limited to a 36% Ni Invar alloy. Similar effects may be obtained with iron-nickel type alloys such as 42% Ni alloy, a Super Invar obtained by the addition of cobalt to an Fe-Ni alloy, and the like.

In summary, the present invention provides a color picture tube wherein curved surface formability of a shadow mask consisting of an iron-nickel type alloy is improved, and deformation of the shadow mask is prevented, so that the problem of degradation in color purity is eliminated.

What is claimed is:

1. A method for manufacturing a color picture tube, comprising the steps of:

forming a number of apertures in a sheet consisting of a nickel-containing iron alloy;

annealing said sheet in a vacuum of not more than $10^{-1}$ Torr at a temperature of not lower than 1,000° C., so as to reduce a content of manganese in said iron alloy to not more than 0.1% by weight, and to render an austenite grain number both within and at surfaces of said sheet to be less than 7, said austenite grain number being defined by JIS G 0551 of the Japanese Industrial Standards;

forming said sheet after annealing to form a shadow mask; and opposing said shadow mask at a small gap therefrom against a phosphor screen formed on an inner surface of a panel.

2. A method according to claim 1, wherein said sheet comprises Invar steel.

3. A shadow mask for a color picture tube, manufactured by the method of claim 1.

* * * * *